United States Patent [19]

Retallick

[11] 4,377,205

[45] Mar. 22, 1983

[54] LOW PRESSURE COMBUSTOR FOR GENERATING STEAM DOWNHOLE

[76] Inventor: William B. Retallick, 1432 Johnny's Way, West Chester, Pa. 19380

[21] Appl. No.: 241,095

[22] Filed: Mar. 6, 1981

[51] Int. Cl.[3] ..... E21B 43/24

[52] U.S. Cl. ..... 166/59; 166/302; 122/4 D; 122/367 C

[58] Field of Search ..... 166/59, 302, 57, 58, 166/256, 272; 252/477 R; 122/4 D, 235 C, 367 C, DIG. 3; 60/723

[56] References Cited

U.S. PATENT DOCUMENTS

| | | | |
|---|---|---|---|
| 1,115,411 | 10/1914 | Dixon | 122/367 C |
| 2,734,578 | 2/1956 | Walter | 166/57 |
| 2,778,610 | 1/1957 | Bruegger | 122/4 D |
| 3,302,705 | 2/1967 | Witten, Jr. | 122/367 C |
| 3,980,137 | 9/1976 | Gray | 166/59 |
| 4,091,768 | 5/1978 | Widdershoven | 122/367 C |
| 4,237,973 | 12/1980 | Todd | 166/59 |

OTHER PUBLICATIONS

Deep Steam Project Quarterly Report for Jan. 1–Mar. 31, 1980; Donaldson et al.; Sandia Nat. Lab. 10/80.

*Primary Examiner*—James A. Leppink
*Assistant Examiner*—Hoang C. Dang
*Attorney, Agent, or Firm*—Paul & Paul

[57] ABSTRACT

A compact catalytic combustor for generating steam downhole in an oil reservoir has steam generating tubes that are attached to a metal catalyst support. The metal support comprises sheets of metal that are spaced apart and transverse to the tubes. Heat from combustion is generated on the metal sheets and is conducted to the steam generating tubes. The steam is injected into the oil reservoir. The combustion gas is vented to ground level.

4 Claims, 3 Drawing Figures

LOW PRESSURE COMBUSTOR FOR GENERATING STEAM DOWNHOLE

BACKGROUND OF THE INVENTION

This invention relates to a catalytic combustor for generating steam downhole in an oil reservoir. By "downhole" it is meant that the steam is generated at or near the bottom of an oil well. The steam is injected into the reservoir to displace heavy oil. Steam injected this way forces oil out of the reservoir and into other wells located nearby. In the first attempts to do this, the steam was generated at ground level and fed to the reservoir through a pipe that extended down the oil well to the reservoir. This method is limited to depths of 3000 feet or less because too much of the steam condenses during the long passage down the well to the reservoir. One subject of Project Deep Steam, sponsored by the U.S. Department of Energy, is to develop a downhole steam generator.

Two types of downhole combustor are being developed. The first is a low pressure combustor wherein the heat from combustion is transferred to boiling water through the metal wall of a heat exchanger. The combustion gas is vented to ground level. This is the low pressure combustor because the combustion takes place at pressures not far above atmospheric. Only the steam is at the high pressure necessary to force the steam into the reservoir. In the high pressure combustor, a mixture of steam and combustion gas is formed by vaporizing water directly into the hot combustion gas. The combustion takes place at the high pressure necessary to force the mixture into the reservoir. The present invention relates to low pressure combustors.

One example of a downhole catalytic combustor is found in my copending U.S. patent application, Ser. No. 208,674, filed Nov. 20, 1980, entitled "Downhole Steam Generating Process." Another example of the use of catalytic combustion is found in my copending U.S. patent application, Ser. No. 145,597, filed May 1, 1980, entitled "Catalytic Heater."

SUMMARY OF THE INVENTION

The present invention comprises a stack of rings, each ring being coated with catalyst, and the rings having holes through which tubes can pass. These tubes are designated herein as steam generating tubes. Heat for generating steam is produced by catalytic combustion of a liquid or gas fuel, the combustion having been started by conventional sparkplug means. Water passing through the tubes is heated due to the catalytic combustion, and becomes steam, which can be channeled to the bottom of the oil well. Combustion exhaust gases are vented to the air. The apparatus is called a low-pressure combustor because combustion occurs at a pressure only slightly higher than atmospheric pressure.

It is an object of the invention to provide a catalytic combustor for generating steam downhole, so that the steam can be injected directly into the oil reservoir.

It is another object to provide a catalytic combustor that is compact.

It is another object to provide a catalytic combustor wherein the catalyst support is made of metal that has high thermal conductivity and cannot shatter from thermal shock.

It is another object to provide a catalytic combustor wherein the metal catalyst support is attached to the steam generating tubes, so that there is a high rate of heat transfer to the tubes.

It is another object to provide a catalytic combustor wherein the combustion is complete so that no soot is formed.

It is another object to provide a catalytic combustor wherein the thermal inertia of the combustor will reignite the combustion after a short interruption in the supply of fuel of air.

Other objects and advantages will be apparent to those skilled in the art, from a reading of the following brief description of the drawings, the detailed description of the invention, and the appended claims.

DETAILED DESCRIPTION OF THE INVENTION

Figure 1:
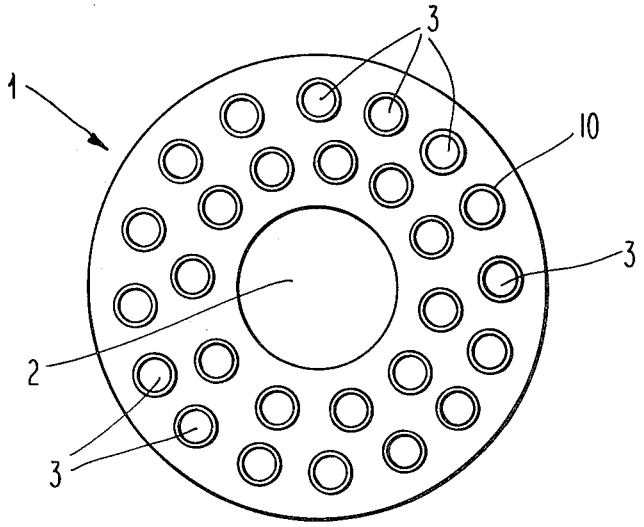
FIG. 1 is a plan view of one of the rings used to construct the catalytic combustor.

FIG. 1 shows a ring 1 made from sheet metal and coated with catalyst. A plurality of rings of this type are stacked to form a catalytic combustor having the general shape of a cylinder. The cylinder thus has a hollow core defined by the central holes 2 in the rings 1. Ring 1 has small holes 3 spaced around the circumference of the ring. The holes are punched out in such manner as to leave grommets 10. Grommets 10 provide some separation between adjacent rings, when the rings are stacked, as will be described below.

The small holes 3 are adapted to receive tubes through which water and steam can pass. The tubes define a cylindrical nest that surrounds the core of the stack.

Figure 2:
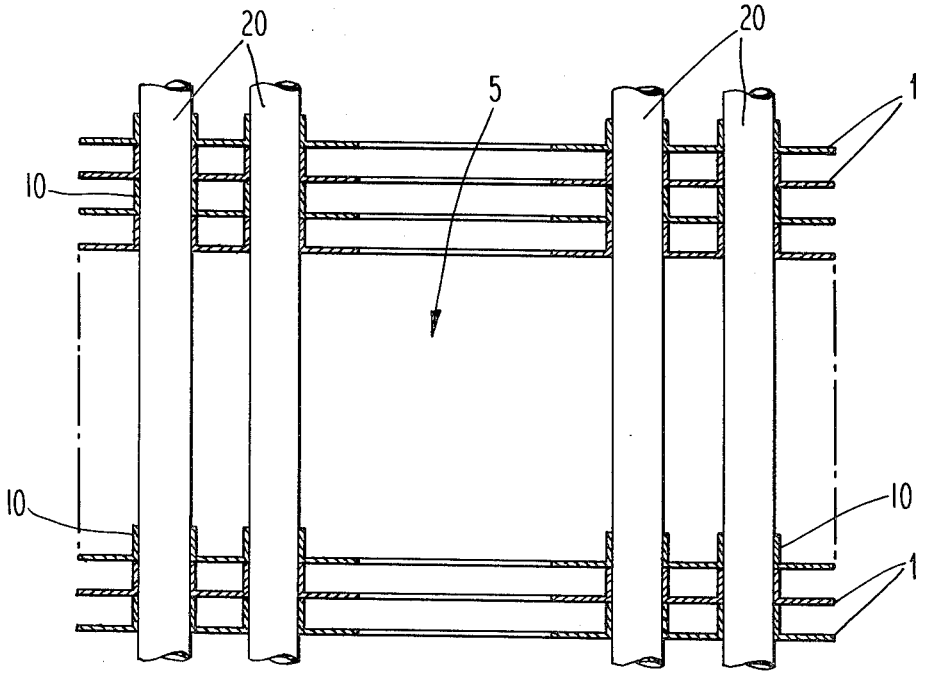
FIG. 2 is a fragmentary cross-sectional view of a stack of rings forming a catalytic combustor, also showing steam tubes passing through holes in the rings.

FIG. 2 shows a partially fragmentary cross-section of a stack of rings 1 having steam generating tubes 20 passing through the rings. Grommets 10 are more plainly visible in FIG. 2, and this figure clearly shows the grommets 10 providing separation between adjacent rings 1. Thus, a fuel mixture can flow radially outward from the core 5, between the stacked rings. The rings are attached to the tubes 20 in such a manner that heat can be conducted from the rings 1 to the tubes 20.

Figure 3:
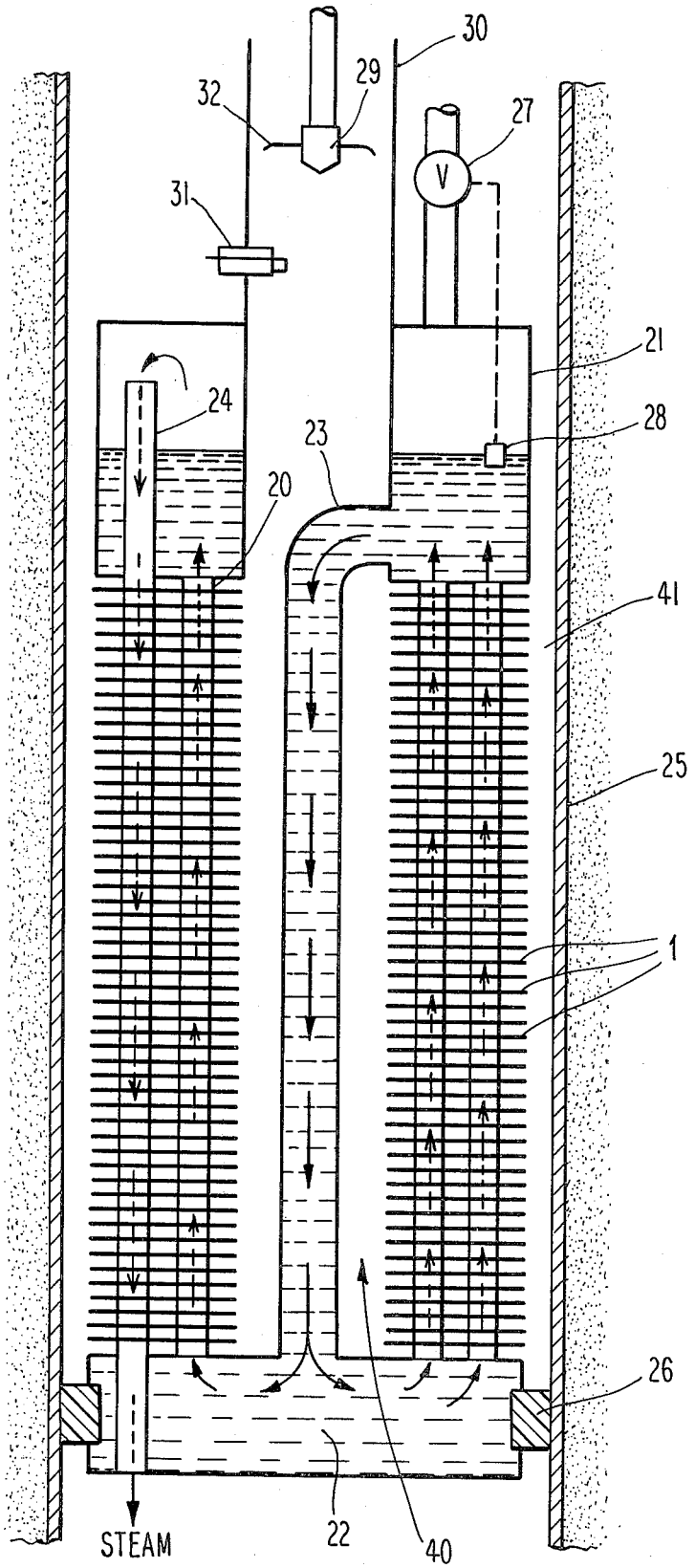
FIG. 3 is a partially schematic, cross-sectional view of the overall apparatus for generating steam downhole.

FIG. 3 is a cross-sectional view of the full length of a catalytic steam generator. In this figure, the rings 1 are shown stacked to form a cylindrical structure. Steam generating tubes 20 terminate at their upper ends in a steam-water separator 21. Tubes 20 terminate at their lower ends in a water header 22. Water is recirculated from separator 21 to header 22 through a downcomer 23. Steam leaves the generator through tubes 24 that pass through header 22 and deliver steam into the oil well casing below the steam generator. A pressure seal is made between the wall of the casing 25 and the steam generator by packing 26. The entire apparatus is typically three or more feet long, and is placed at or near the bottom of an oil well.

The influx of water for making steam is controlled by valve 27 and water level sensing device 28. A fuel-air mixture enters through injector nozzle 29 and mixes with air that enters through tube 30. The mixture is initially ignited by conventional means such as glow plug 31, and forms a flame in the bore 40 of the combustor. Flame holder 32 anchors the flame in place and prevents the flame from blowing out. When the catalyst is hot enough to support the combustion catalytically, the fuel is shut off momentarily to extinguish the flame. Then the flow of fuel is resumed and the combustion proceeds on the catalyzed surface of the metal rings.

Water passing through downcomer 23 and water header 22 is drawn upwards through tubes 20 by a thermosiphoning effect. Heat from the catalytic combustion is transmitted to tubes 20, because of the snug attachment of the tubes to the rings 1. As steam enters separator 21, the steam bubbles through the water, and is collected by tube 24 and delivered to the oil reservoir. The supply of water in separator 21 is maintained by water level sensing device 28, which is operatively connected to valve 27 in a conventional manner. Meanwhile, combustion exhaust gases pass radially outward, due to pressure from additional fuel being forced into bore 40, and these gases are vented to the air through exhaust path 41.

Some advantages of this design are:

1. The combustor is cylindrical so that it fits neatly into the oil well.
2. The hollow core extends the full length of the stack so that a single fuel inlet, such as nozzle 29, supplies the entire stack.
3. The stack is perfectly symmetrical, so that the flow rate through the stack is uniform everywhere.
4. There is a high rate of heat transfer to the steam generating tubes because the heat is released on a metal catalyst support, namely the stack of rings 1, the stack being attached so as to have a relatively large amount of direct contact with the tubes 20.
5. The metal catalyst support cannot shatter from thermal shock.

This combination of advantages arises from the use of the metal catalyst support present in the combustor, i.e. the sheet metal rings described above. These advantages would not be obtained when the catalyst is held on prior art supports made of ceramic materials.

The reason for using a catalyst to promote combustion is to drive the combustion to completion, and so to remove pollutants from the combustion gas. One pollutant which must be removed is soot, or the heavy molecules that are the precursors of soot. Soot can be deposited on the steam generating tubes and lower the rate of heat transfer to the tubes.

There is a practical method for attaching the metal rings 1 to the tubes. When the holes for the tubes are punched in the rings, the edge of the hole is rolled back to form grommet 10, as discussed above. When the rings are stacked up, the grommets maintain the spacing between the rings. Then the tubes are expanded to make a tight fit in the grommets. The tubes can be expanded by forcing a mandrel through the tubes, or by using a tube roller like those used to expand tubes into the tube sheets in heat exchangers. If the rings were not attached to the tubes, the spacing could be maintained by indenting the rings, as is done in my copending patent application, Ser. No. 145,597, filed May 1, 1980. The rings are attached to the tubes in the preferred design.

One problem that can occur with the catalytic combustor, as described, is the expansion of the rings 1, due to the high temperatures in the regions of combustion. Such expansion tends to cause the tubes 20 to bow out, and possibly to disengage from the water header 22. This problem is alleviated by inserting a radial slot in each ring, thereby allowing for some expansion without damage to the apparatus.

It is understood that many design modifications can be made to this invention, and that the following claims should not be considered limited to the precise embodiments described above.

What is claimed is:

1. A catalytic combustor for generating steam at or near the bottom of an oil well, comprising:

a stack of rings made from sheet metal, the stack having a hollow core defined by central holes in the rings, the rings being spaced apart sufficiently to allow a fuel-air mixture to flow from the core of the stack outwardly between the rings, the rings being coated with a catalyst, and the stack of rings being traversed by steam generating tubes that are positioned around the core of the stack.

2. The catalytic combustor of claim 1, wherein the rings are attached to the tubes.

3. The catalytic combustor of claim 2, further comprising means to recirculate water through the tubes, and means to remove the steam that is generated.

4. The catalytic combustor of claim 3, including means to ignite the combustion.

* * * * *

UNITED STATES PATENT OFFICE

CERTIFICATE OF CORRECTION

Patent No. 4,377,205 Dated March 22, 1983

Inventor(s) William B. Retallick

It is certified that error appears in the above-identified patent and that said Letters Patent are hereby corrected as shown below:

Column 1, line 19, "subject" should be --object--.

Signed and Sealed this

*Twenty-first* Day of *June 1983*

[SEAL]

*Attest:*

DONALD J. QUIGG

*Attesting Officer*

*Acting Commissioner of Patents and Trademarks*